US007093980B2

(12) United States Patent
Iijima

(10) Patent No.: US 7,093,980 B2
(45) Date of Patent: Aug. 22, 2006

(54) BEARING STRUCTURE FOR CAMSHAFT

(75) Inventor: Akira Iijima, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 179 days.

(21) Appl. No.: 10/805,895

(22) Filed: Mar. 22, 2004

(65) Prior Publication Data

US 2004/0190807 A1 Sep. 30, 2004

(30) Foreign Application Priority Data

Mar. 25, 2003 (JP) ..... 2003-082021

(51) Int. Cl.
*F16C 35/00* (2006.01)
*F01L 1/053* (2006.01)

(52) U.S. Cl. ..... 384/294; 384/433

(58) Field of Classification Search ..... 384/288, 384/294, 322, 397, 433; 123/90.34, 90.38
See application file for complete search history.

(56) References Cited

U.S. PATENT DOCUMENTS

| | | | | |
|---|---|---|---|---|
| 4,537,166 | A * | 8/1985 | Kimura et al. | 123/90.34 |
| 4,823,747 | A | 4/1989 | Wagner et al. | 123/193 |
| 5,186,129 | A * | 2/1993 | Magnan et al. | 123/90.34 |
| 5,458,099 | A | 10/1995 | Koller et al. | 123/193.5 |
| 6,035,817 | A | 3/2000 | Uchida | 123/90.17 |
| 6,237,719 | B1 * | 5/2001 | Fujii et al. | 384/288 |

FOREIGN PATENT DOCUMENTS

| | | |
|---|---|---|
| EP | 1 239 136 A1 | 9/2002 |
| JP | 63-079717 | 4/1988 |
| JP | 06-317113 | 11/1994 |
| JP | 08-218836 | 8/1996 |
| JP | 09-079019 | 3/1997 |

OTHER PUBLICATIONS

Copy of European Search Report for Serial No. EP 04 00 6853 dated Jun. 15, 2005.

* cited by examiner

*Primary Examiner*—Thomas R. Hannon
(74) *Attorney, Agent, or Firm*—McCormick, Paulding & Huber LLP

(57) ABSTRACT

The present invention is directed to a bearing structure for a camshaft to prevent obliquely wiping off the oil from the surface of the camshaft caused by a knife edge. A lower journal (3) for supporting the camshaft (2) is formed with a counterbore (6) cutting off a part of a bearing surface (5) of the lower journal (3). A connecting part between the bearing surface (5) and the counterbore (6) is formed with a recess (11) hollowed from the bearing surface (5). A part of an edge (11*a*) connecting the recess (11) to the bearing surface (5) is elongated along a perpendicular direction to an axis of the bearing surface (O5), and a remaining part of the edge (11*b*) is elongated along a parallel direction to the axis (O5). The part of the edge (11*a*) does not wipe off the oil in the axis direction (O5), while the oil wiped by the remaining part of the edge (11*b*) is received into the recess (11) and is used for lubrication.

8 Claims, 6 Drawing Sheets

BEARING STRUCTURE FOR CAMSHAFT

CROSS REFERENCE TO RELATED APPLICATION

Applicants hereby claim foreign priority benefits under U.S.C. §119 of Japanese Patent Application No. 2003-82021, tiled on Mar. 25, 2003, and the content of which is herein incorporated by reference.

BACKGROUND OF THE INVENTION

1. Field of the Invention

The present invention relates to a bearing structure, in particular, a bearing structure for a camshaft in which a counterbore or a spot facing is formed to a part of a bearing surface of a lower journal.

2. Description of the Related Art

As shown in FIGS. 4 and 5, with regard to a camshaft 2 supported on a cylinder head 1 of the OHC engine, the camshaft 2 is clamped between a lower journal 3 provided in the cylinder head 1 and an upper journal (not shown) fixed thereon, and is rotatably supported by them. A plurality of lower journals 3 are aligned in an axis direction of the camshaft at certain intervals.

Each lower journal is supplied with oil from cylinder head side to lubricate interface between the lower journals and the camshaft. It is also known that only one lower journal 3 can be provided with oil and the oil is in turn provided to other lower journals via the camshaft 2. The cylinder head 1 is secured onto the cylinder body by head bolts (not shown) penetrating the cylinder head 1.

In recent years, it is required that an engine is smaller and lighter but more powerful. Therefore, bore pitch between cylinders becomes narrower, and the number of head bolts and valves becomes more. For this reason head bolts are close to the lower journals 3, and thus counterbores for head bolts interfere with bearing surfaces of the lower journals 3 in the cylinder head 1. This type of the cylinder head is known as described in paragraph 0006 and 0007, and FIG. 21 of Japanese Patent Application published by No. 8-218836, for example.

In this type, as shown in FIG. 6, while a counterbore face 4 for the head bolt is formed in the cylinder head 1, a cutting tool is moved down from above the cylinder head 1 to the level of the counterbore face 4 for the head bolt. In this process a part of the bearing surface 5 is cut off at where the route of the cutting tool overlaps with the bearing surface 5, thereby the counterbore 6 with a sharp edge is formed in the lower journal 3.

In FIG. 6, an upper end surface of the cylinder head is depicted by hatching. Numeral 4 shows the counterbore face for the head boils which is lower than the bearing surface 5. Numeral 7 shows a hole into which the head bolt is inserted. Numeral 8 shows a hole into which an injector is attached. Numeral 9 shows a female screw into which a bolt to secure the upper journal is engaged. X shows a hole for an inlet or exhaust valve stem.

Meanwhile, a connection part between the counterbore 6 and the bearing surface 5 is formed with a sharp, arc-of-circle like knife edge 10 as shown in FIGS. 7 to 9, because the cutting tool cut off a part of the bearing surface 5 when the counterbore face 4 is machined by the cutting tool in the cylinder head 1.

This knife edge 10 contacts with the surface of the camshaft 2 at an angle, then wipes off the oil from the surface of the camshaft 2 (knife edge function), because its relative contact point to the surface of the camshaft moves in turn in the width direction of the bearing surface 5 as the camshaft 2 rotates. This may cause lubrication failure against the camshaft 2.

SUMMARY OF THE INVENTION

It is an object of the present invention to provide a bearing structure for a camshaft which can prevent obliquely wiping off the oil from the surface of the camshaft caused by a knife edge.

It is another object of the present invention to provide a bearing structure for a camshaft which can prevent wiping off the oil from the surface of the camshaft in the axis direction of the camshaft.

It is further object of the present invention to provide a bearing structure for a camshaft which can collect the oil to be wiped off from the surface of the camshaft.

According to a first aspect of the present invention there is provided a bearing structure for a camshaft comprising a lower journal for supporting the camshaft thereon, the lower journal being formed with a hole cutting off a part of a bearing surface of the lower journal, wherein a connecting part between the bearing surface and the hole is formed with a recess hollowed from the bearing surface so that a bottom surface of the recess is apart from the bearing surface, and a part of an edge connecting the recess and the bearing surface to each other is elongated in a perpendicular direction to an axis of the bearing surface.

Preferably, a remaining part of an edge is elongated along a parallel direction to the axis of the bearing surface.

Preferably, the recess has a side surface connecting to the bearing surface.

Preferably, the side surface comprises a first side surface and a second side surface, the first side surface involves the part of the edge and is elongated in the perpendicular direction to the axis of the bearing surface, and the second side surface involves the remaining part of the edge and is elongated in the parallel direction to the axis of the bearing surface.

Optionally, the side surface has a ramp crossing to the bearing surface at an angle of less than 90°.

Optionally, the side surface has a curved surface tangentially crossing to the bearing surface.

Preferably, the bottom surface of the recess connects to the side surface.

Preferably, the bottom surface is parallel to the bearing surface.

Preferably, the hole is formed in a region where the surface of the camshaft moves downwardly.

Optionally, the hole is a counterbore.

Optionally, the hole is offset in the axis direction of the bearing surface relative to a center of width of the bearing surface.

Preferably, a width of the bearing surface (L1) is wider than a standard width (L2) such that the areas of the bearing surface to be lost by providing the recess is compensated.

According to a second aspect of the present invention there is provided a bearing structure for a camshaft comprising a lower journal for supporting the camshaft thereon, the lower journal being formed with a counterbore cutting off a corner part of a bearing surface of the lower journal in an arc-of-circle like manner, wherein a connecting part between the bearing surface and the counterbore is formed with an approximately triangular recess hollowed from the bearing surface so that a bottom surface of the recess is apart from the bearing surface, and an edge connecting the recess and the bearing surface to each other comprises a first edge being elongated in a perpendicular direction to an axis of the bearing surface, and a second edge being elongated in a parallel direction to the axis of the bearing surface.

Preferably, the recess has a side surface connecting to the bearing surface, and the side surface comprises a first side surface involving the first edge and a second side surface involving the second edge.

Optionally, at least one of the first side surface and the second side surface has a ramp crossing to the bearing surface at an angle of less than 90°.

Optionally, at least one of the first side surface and the second side surface has a curved surface tangentially crossing to the bearing surface Preferably, the bottom surface of the recess connects to the side surface.

Preferably, the bottom surface is parallel to the bearing surface.

Preferably, the counterbore is formed in a region where the surface of the camshaft moves downwardly.

Optionally, the counterbore is offset in the axis direction of the bearing surface relative to a center of width of the bearing surface.

These and other object of the present invention, and their preferred embodiments, shall become clear by consideration of the specification, claims and drawings taken as a whole.

DESCRIPTION OF THE PREFERRED EMBODIMENTS

Figure 1A:
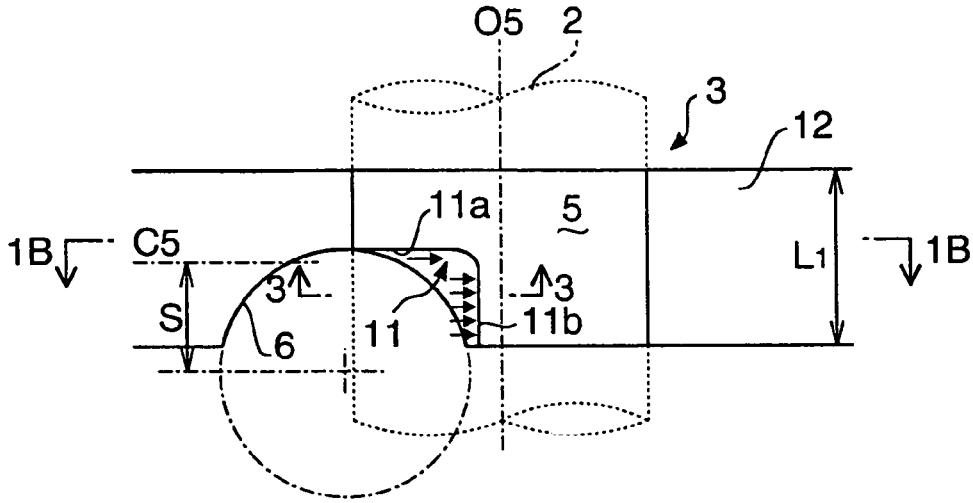
FIG. 1A is a plan view of the bearing structure for the camshaft according to the present invention.

The preferred embodiment of the present invention will be described hereinbelow based on the appended drawings.

A bearing structure for a camshaft relating to the preferred embodiment is applied to the cylinder head 1 of the OHC engine as described above with reference to FIGS. 4–7, therefore, same parts as described above are not detailed, but are provided with the same numerals in the drawings. As described above, a plurality of lower journals 3 is formed in the cylinder head 1, and the lower journals are aligned in the axis direction of the inlet and exhaust camshafts at certain intervals. Counterbores 6 are respectively formed in each of the lower journals 3, which cut off a part of the bearing surface of the lower journal 3.

Figure 1B:
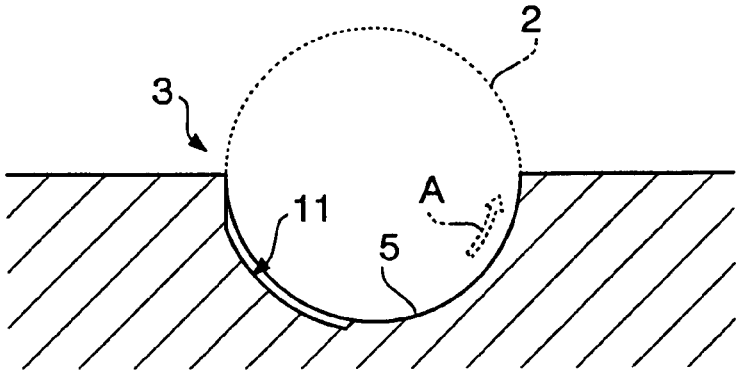
FIG. 1B is a sectional view taken along line 1B—1B of FIG. 1A.

In detail, the basic configuration of the bearing surface 5 of the lower journal is approximately rectangular in plan view as shown in FIG. 1A, and is semicircular in side view as shown in FIG. 1B. As shown in FIG. 1A, the counterbore 6 is formed at a corner part in plan view of the bearing surface 5. The counterbore 6 is formed at a region B where the surface of the camshaft moves downwardly, and is positioned at an end of the bearing surface 5 in its width (L1) direction. The counterbore 6 is offset relative to a center C5 of the width L1 of the bearing surface 5 in the axis direction of the bearing surface 5 at length S.

Figure 2:
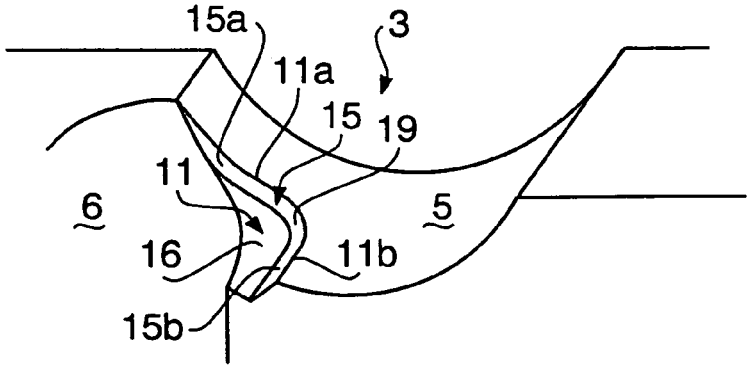
FIG. 2 is a perspective view of the bearing structure.

As also shown in FIG. 2, a recess 11 is formed in the connecting part between the counterbore 6 and the bearing surface 5. The recess 11 is hollowed from the bearing surface 5 so that a bottom surface of the recess is apart from the bearing surface 5 or the surface of the camshaft 2. The recess 11 is stepped down in parallel from the bearing surface 5 (ie., from the surface of the camshaft 2) at a length of several mm (about 1 mm for example). A part of an edge connecting the recess 6 and the bearing surface 5 to each other comprises a first edge 11*a* elongated in the perpendicular direction to an axis of the bearing surface O5 (or elongated in a rotational direction A of the camshaft 2). A remaining part of the edge comprises a second edge 11*b* elongated in the parallel direction of the axis of the bearing surface O5 (or elongated in the direction perpendicular to the rotational direction A of the camshaft 2).

As shown in FIG. 1A, the recess 11 is configured to be an approximately right-angled triangle. As shown in FIGS. 2 and 3A–3D in detail, the recess 11 has a side surface 15 connecting to the bearing surface 5 and having a vertical length, and a bottom surface 16 connecting to the side surface 15 and being parallel to the bearing surface 5. The side surface 15 comprlses a first side surface 15*a* involving the first edge 11*a*, a second side surface 15*b* involving the second edge 11*b*, and a curved side surface 19 connecting the first side surface 15*a* and the second side surface 15*b* to each other.

Figure 3A:
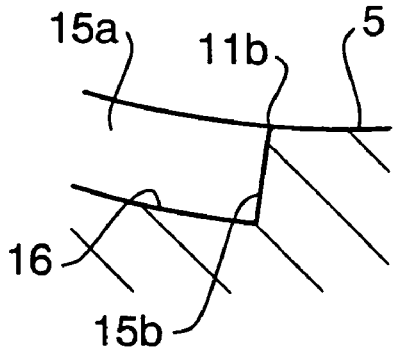
FIGS. 3A–3D is sectional views taken along line 3—3 of FIG. 1A.
Figure 3B:
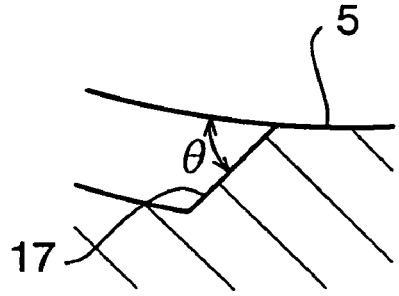
Figure 3C:
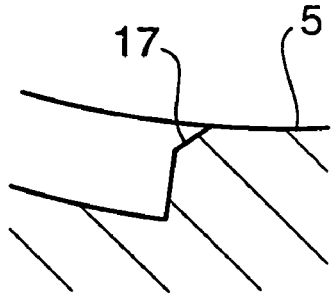
Figure 3D:
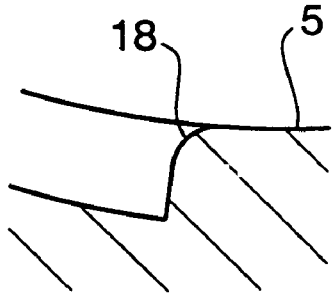
Figure 4:
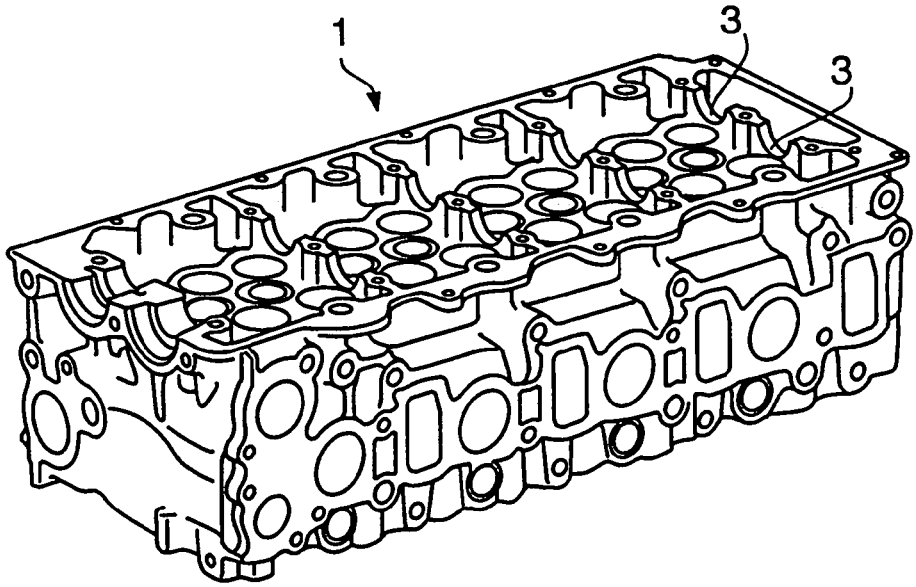
FIG. 4 is a perspective view of the cylinder head.
Figure 5:
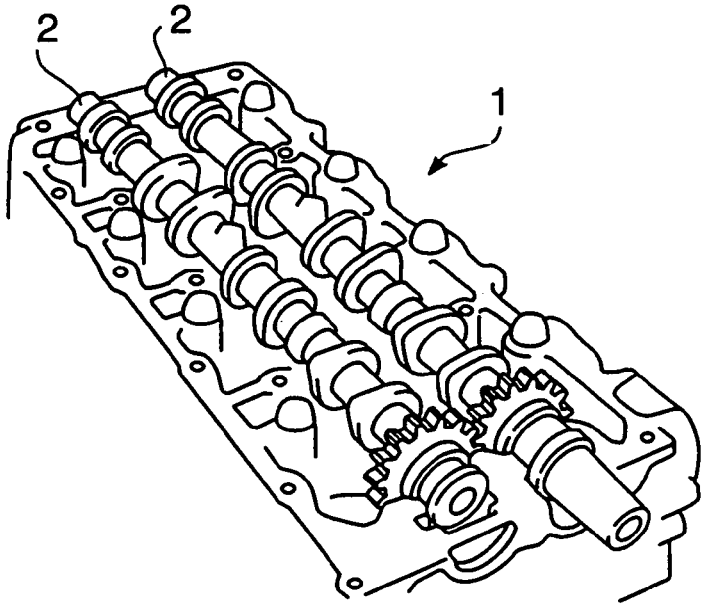
FIG. 5 is a perspective view of the cylinder head and the camshaft.
Figure 6:
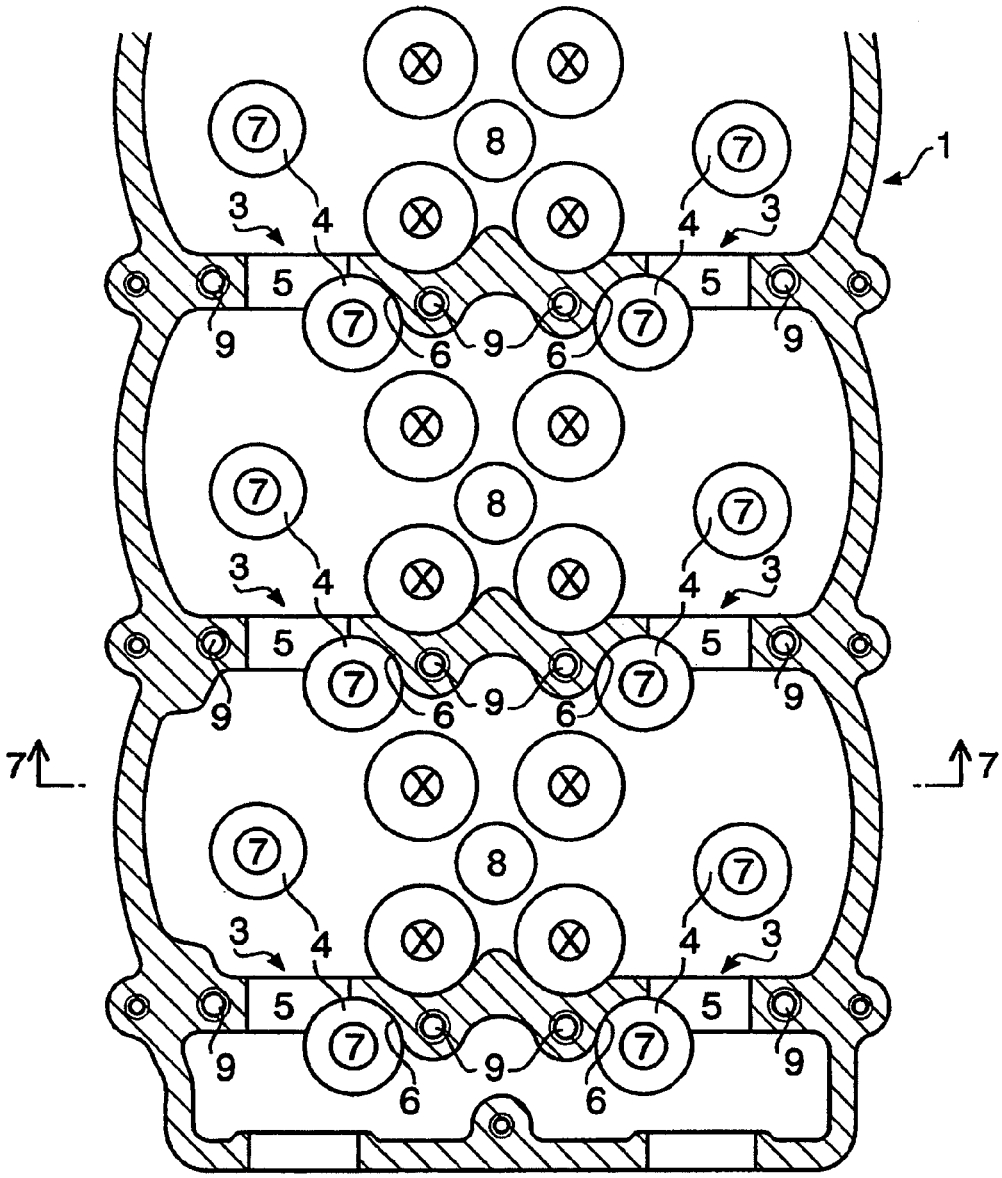
FIG. 6 Prior Art
FIG. 6 is a plan view of the cylinder head.
Figure 7:
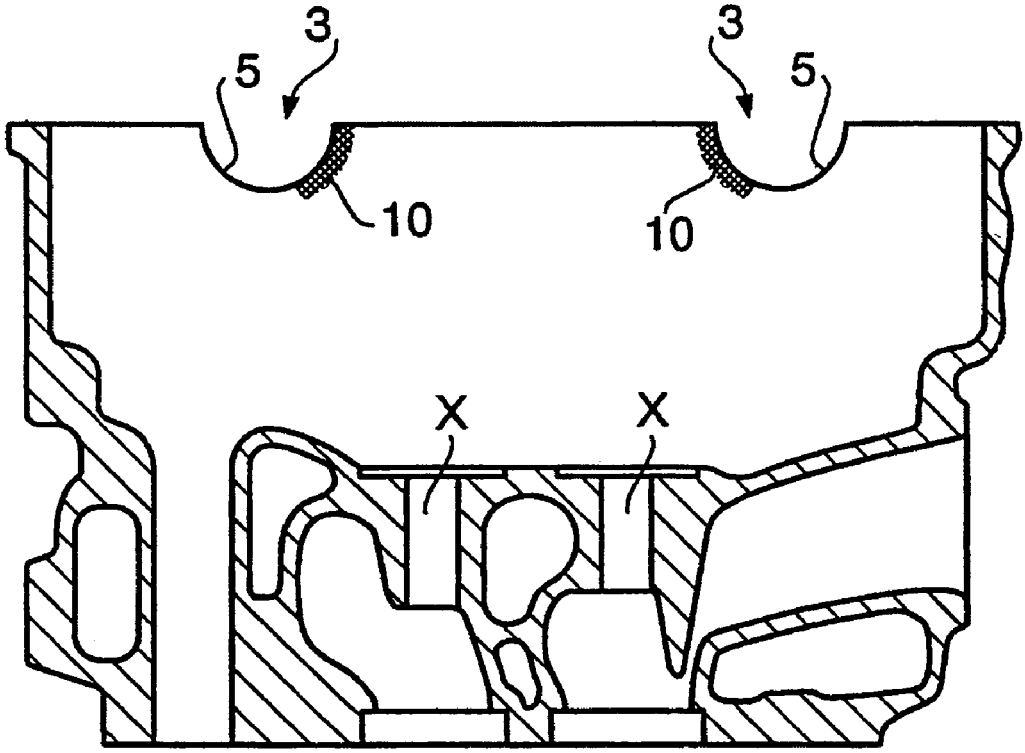
FIG. 7 Prior Art
FIG. 7 is a sectional view taken along line 7—7 of FIG. 6.

While FIGS. 3A–3D representatively show sectional views around the second side surface 15*b* the same structures are applicable to views around the first side surface 15*a*. As shown in FIG. 3A, the first side surface 15*a* and/or the second side surface 15*b* may be simply a flat plane perpendicular to the bearing surface 5. Optionally, as shown in FIGS. 3B and 3C, the first side surface 15*a* and/or the second side surface 15*b* may have a ramp 17 crossing to the bearing surface 5 at an angle θ of less than 90° to the bearing surface 5. As shown in FIG. 3B, the ramp 17 may be provided in the whole of the first side surface 15*a* and/or the second side surface 15*b*. Or, as shown in FIG. 3C, the ramp 17 may be provided at only the top part of the first side surface 15*a* and/or the second side surface 15*b*. In this case the ramp 17 is made by chamfering. As shown in FIG. 3D, the first side surface 15*a* and/or the second side surface 15*b* may have a curved surface 18 crossing tangentially to the bearing surface 5. The curved surface 18 may be provided in either the whole or only the top part of the first side surface 15*a* and/or the second side surface 15*b*.

A function of the preferred embodiment is described hereinafter.

As is understood from FIGS. 1A, 1B and 2, the camshaft 2 is clamped to be supported by the lower journal 3 and the upper journal (not shown) fixed thereon. In operation the camshaft 2 rotates in a direction shown by arrow A.

As the camshaft 2 rotates, the oil adhered onto the surface of the camshaft 2 firstly approaches the first edge 11*a* of the recess 11. Here, the first edge 11*a* does not wipe off the oil from the surface of the camshaft 2 in the width direction of the bearing surface 5 (or the axis direction of the camshaft 2), because the first edge 11*a* extends in the perpendicular direction to the axis of the bearing surface O5 (or extends along the rotational direction of the camshaft A).

Subsequently, the oil adhered onto the surface of the camshaft 2 approaches the second edge 11*b* of the recess 11 as the camshaft 2 rotates. Here, the second edge 11*b* wipes off the oil from the surface of the camshaft 2, because the second edge 11*b* extends in the parallel direction to the axis of the bearing surface O5. However, the second edge 11*b* does not wipe off the oil obliquely towards the width direction of the bearing surface 5 as performed by the conventional type of the structure shown in FIGS. 8A, 8B and 9, but wipes off the oil downwardly. Accordingly, the oil wiped off is, in cooperation with an effect of gravity, received into the recess 11 for the moment. Thus, lubrication performance is secured.

Figure 8A:
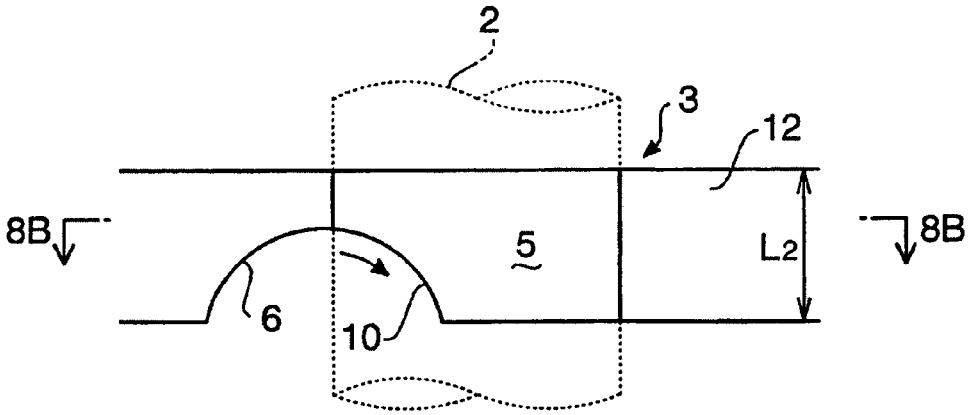
FIG.8A Prior Art
FIG. 8A is a plan view of a conventional type of a bearing structure for a camshaft.
Figure 8B:
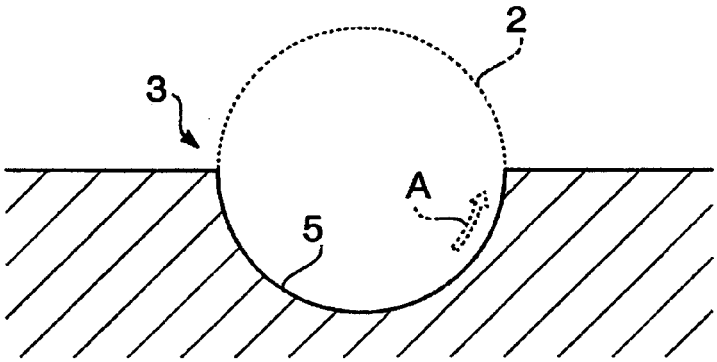
FIG.8B Prior Art
FIG. 8B is a sectional view taken along line 8B—8B of FIG. 8A.
Figure 9:
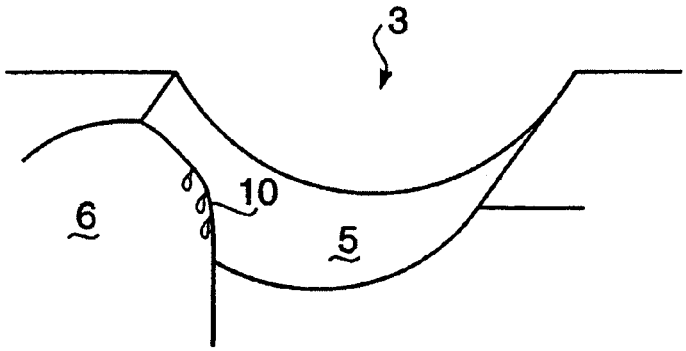
FIG. 9 Prior Art
FIG. 9 is a perspective view of the conventional type of the bearing structure.

That is, in the preferred embodiment, there is no knife edge which is sharp and arch shaped as in the conventional type shown in FIGS. 8A, 8B and 9, therefore it is not caused that the oil is wiped off from the surface of the camshaft by knife edge effect. The term "knife edge effect" is used to refer to an operation that the oil adhered onto the surface of the shaft is obliquely wiped off while a relative contact point to the surface of the shaft 2 successively moves in the width direction of the bearing surface 5 as the shaft 2 rotates.

And then, the oil wiped off downwardly by the second edge 11*b* is, because this is not applied with thrust force in the width direction, received into the recess 11 for the moment in cooperation with an effect of gravity. The oil received is successively adhered onto the surface of the camshaft 2, and is trailed out of the recess 11 by the camshaft 2 which intends to rotate upwardly. Thus, lubrication for interface between the camshaft 2 and the bearing surface 5 improves.

Further, in the preferred embodiment, the second edge 11*b* wiping off the oil is formed along the parallel direction to the axis of the bearing surface O5. Therefore, a length functioning as a wiping member of the second edge 11*b* is shorter than that of the knife edge 10 of the conventional type shown in FIGS. 8A, 8B and 9 which is oblique relative to the axis O5 and arched. Accordingly, an amount of oil to be swiped in the preferred embodiment is less than that in the conventional type.

In the meantime, with regard to the bearing structure of the preferred embodiment, as the recess 11 is depressed in the lower journal 3, the bearing area contacting to the surface of the camshaft 2 becomes smaller at the area of the recess 11, compared to the bearing area of the conventional type not having the recess 11. This causes increase of bearing pressure. Therefore, in the preferred embodiment, the width of the bearing surface L1 is wider than that of the conventional type such that the lost area by providing recess 11 is compensated, in order to secure a same amount of bearing pressure. That is, a width L1 of a rib 12 (FIG. 1A) formed with the bearing surface 5 in the preferred embodiment is wider than the standard width L2 of the rib 12 (FIG. 8A) in the conventional type.

As described above, according to the bearing structure of the present invention, it is possible to prevent wiping off the oil caused by the knife edge.

In light of the significance of the present invention, the invention may be applied to any hole which cuts off a part of the bearing surface. Besides the counterbore 6 shown in the preferred embodiment, either a simple bolt hole or a sunk hole is applicable for example.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A bearing structure for a camshaft comprising a lower journal for supporting the camshaft thereon, the lower journal being formed with a counterbore cutting off a corner part of a bearing surface of the lower journal in an arc-of-circle like manner, wherein a connecting part between the bearing surface and the counterbore is formed with an approximately triangular recess hollowed from the bearing surface so that a bottom surface of the recess is apart from the bearing surface, and an edge connecting the recess and the bearing surface to each other comprises a first edge being elongated in a perpendicular direction to an axis of the bearing surface, and a second edge being elongated in a parallel direction to the axis of the bearing surface.

2. The bearing structure as defined by claim 1, wherein the recess has a side surface connecting to the bearing surface, and the side surface comprises a first side surface involving the first edge and a second side surface involving the second edge.

3. The bearing structure as defined by claim 2, wherein at least one of the first side surface and the second side surface has a ramp crossing to the bearing surface at an angle of less than 90°.

4. The bearing structure as defined by claim 2, wherein at least one of the first side surface and the second side surface has a curved surface tangentially crossing to the bearing surface.

5. The bearing structure as defined by claim 2, wherein the bottom surface of the recess connects to the side surface.

6. The bearing structure as defined by claim 5, wherein the bottom surface is parallel to the bearing surface.

7. The bearing structure as defined by claim 1, wherein the counterbore is formed in a region where the surface of the camshaft moves downwardly.

8. The bearing structure as defined by claim 1, wherein the counterbore is offset in the axis direction of the bearing surface relative to a center of width of the bearing surface.

* * * * *